US010612117B2

(12) United States Patent
Gaddam et al.

(10) Patent No.: US 10,612,117 B2
(45) Date of Patent: Apr. 7, 2020

(54) PROCESS FOR MANUFACTURING A PRODUCT OF COMMERCIALLY PURE TITANIUM

(71) Applicant: SANDVIK INTELLECTUAL PROPERTY AB, Sandviken (SE)

(72) Inventors: Raghuveer Gaddam, Sandviken (SE); Ardeshir Golpayegani, Gavle (SE); Guocai Chai, Sandviken (SE); Mikael Grehk, Borlange (SE)

(73) Assignee: Sandvik Intellectual Property AB, Sandviken (SE)

( * ) Notice: Subject to any disclaimer, the term of this patent is extended or adjusted under 35 U.S.C. 154(b) by 169 days.

(21) Appl. No.: 15/556,660

(22) PCT Filed: Mar. 10, 2016

(86) PCT No.: PCT/EP2016/055151
§ 371 (c)(1),
(2) Date: Sep. 8, 2017

(87) PCT Pub. No.: WO2016/142474
PCT Pub. Date: Sep. 15, 2016

(65) Prior Publication Data

US 2018/0051365 A1 Feb. 22, 2018

(30) Foreign Application Priority Data

Mar. 11, 2015 (EP) ..... 15158671

(51) Int. Cl.
*C22F 1/18* (2006.01)

(52) U.S. Cl.
CPC ..... *C22F 1/183* (2013.01); *C22F 1/18* (2013.01)

(58) Field of Classification Search
CPC ..... C22F 1/183; C22C 14/00
See application file for complete search history.

(56) References Cited

FOREIGN PATENT DOCUMENTS

| | | | |
|---|---|---|---|
| CN | 101580924 | A | 11/2009 |
| CN | 102899508 | A | 1/2013 |
| CN | 103270184 | A | 8/2013 |
| EP | 2468912 | A1 | 6/2012 |
| JP | 2008190039 | A | 8/2008 |
| WO | 99/02750 | A1 | 1/1999 |

OTHER PUBLICATIONS

D.H. Hong et al: "Microstrucural refinement of CP—Ti by cryogenic channel-die compression involving mechanical twinning", Materials Science and Engineering A, vol. 555, Oct. 1, 2012, pp. 106-1169, XP055209327, ISSN: 0921-5093, DOI: 10.1016/j.msea.2012.06.040 the whole document.

D'Yakonov G S et al: "Microstruture evolution of commercial-purity titanium during cryorolling", The Physics of Metals and Metallography/Fizika Metallov Imetallovedenie, Interperiodica Publishing, XX, vol. 116, No. 2, Feb. 28, 2015, pp. 182-188, XP035459654, ISSN: 0031-918X, DOI: 10.1134/S0031918X14090038 [retrieved on Feb. 28, 2015] the whole document.

Tikhonovsky M A et al: "Effect of low-temperature (77K) quasihydrostatic exrusion on the properties of high-purity titanium: The role of initial structural state", Low Temperature Physics, Woodbury, NY, US, vol. 39, No. 11, Jan. 1, 2013, pp. 983-989, XP009185850, ISSN: 1063-777X, DOI: 10.1063/1.4830259 the whole document.

M.J. Donachie, Titanium: A Technical Guide, 2nd Edition, Materials Parkl, OH, USA: ASM International, (2012) (pp. 56-59).

*Primary Examiner* — Jessee R Roe
(74) *Attorney, Agent, or Firm* — Morgan, Lewis & Bockius LLP

(57) ABSTRACT

The present disclosure relates to a process for manufacturing a product of commercially pure titanium, wherein the process includes the steps of mechanically deforming an object of commercially pure titanium in a temperature below −80° C. until the product is formed, and heat-treating the formed product in a temperature range of from 300 to below 450° C. during a treatment time from 10 minutes to 168 hours.

17 Claims, 3 Drawing Sheets

PROCESS FOR MANUFACTURING A PRODUCT OF COMMERCIALLY PURE TITANIUM

RELATED APPLICATION DATA

This application is a § 371 National Stage Application of PCT International Application No. PCT/EP2016/055151 filed Mar. 10, 2016 claiming priority to EP Application No. 15158671.6 filed Mar. 11, 2015.

TECHNICAL FIELD

The present disclosure relates to a new process for manufacturing a product of commercially pure titanium and a product obtained by the process.

BACKGROUND

Titanium may be classified into two categories: commercially pure titanium (CP Ti), which is unalloyed and used in the chemical process industries and titanium alloys having alloying elements such as aluminium (Al) and vanadium (V) that are used for jet aircraft engines, airframes and other components.

Commercially pure titanium (CP Ti) is used within the chemical and medical industry because of its high corrosion resistance and biocompatibility and is defined within grades 1-4 whereof grade 1 is the purest with the lowest strength. Grades 2-4 are alloyed with increasing amounts of O, N, C and Fe and have higher strengths. Limiting factors for the usage of CP Ti are basically low yield strength (about 274 MPa) and low tensile strength (about 345 MPa).

It has been shown, in e.g. EP 2468912, that a significant improvement of tensile properties, such as yield strength and tensile strength has been achieved by deforming CP Ti at cryogenic temperatures but these improvements are not enough as there is no significant improvement in the ductility of the material. In highly demanding applications, such as medical implants and in chemical processing industries, it is desirable to have an object having a combination of high tensile strength and high ductility and thereby achieve long term sustainability and good fatigue properties.

Hong et al (Materials Science and Engineering 555 (2012) 106-116) discloses a process using a two dimensional cryogenic channel-die-compression (CrCDC) for deforming titanium, i.e. they are using compression stresses. In this a process, only plain strain will be introduced in the titanium during compression, which means that the microstructure will be sensitive to stress conditions after deformation, i.e. such as heat treatment.

Hence, there is still a need for a process that will provide a CP Ti product having a combination of high tensile strength and high ductility and good fatigue properties.

SUMMARY OF THE PRESENT DISCLOSURE

The present disclosure therefore relates to a process for manufacturing a product of commercially pure titanium, wherein said process comprises the step of:

a) plastically deforming an object of commercially pure titanium in a temperature below about −80° C. until the product is formed;
b) heat-treating the formed product in a temperature range greater than or equal to about 300 to less than 450° C. during a heat treatment time from about 10 minutes to about 168 hours.

Hence, the present disclosure will provide a process to improve the combined mechanical properties of a product of commercially pure titanium by applying plastic deformation at cryogenic temperatures on an object until the product is formed, and thereafter heat-treating the obtained product.

The present disclosure also relates to a product manufactured according to the present process as defined hereinabove or hereinafter.

DEFINITIONS

According to the present disclosure, the terms "commercially pure titanium" and "CP Ti" and "CP titanium" are intended to mean an alloy comprising at least 95% Ti and small amounts of other elements such as, but not limited to O, N, Al, Sn, C, H, V, Mo, Cr, Nb, Fe, Zr and Hf. An example, but not limiting, of a suitable CP Ti is: nitrogen max 0.05; carbon max 0.08; hydrogen max 0.015; iron max 0.5; oxygen max 0.4; balance titanium.

The term "cryogenic" is intended to mean temperatures below or equal to −80° C.

In the present disclosure, the terms "nano-twin" and "twins" are used interchangeably and are intended to mean a crystal having a distance between its two components that is less than 1 000 nm.

The term "compression twins" refers to nano-twins with a misorientation angle of 64°±5.

The term "tensile twins" refers to nano-twins with a misorientation angle of 85°±5.

The term "about" as used herein is intended to mean plus or minus 10% of the numeric value.

The term "product" is intended to include a wire, a strip, a sheet, a plate, a tube, a bar or a pipe.

DETAILED DESCRIPTION

The present disclosure relates to a process for manufacturing a product of commercially pure titanium, wherein said process comprises the step of:

a) plastically deforming an object of the commercially pure titanium in a temperature below −80° C. until the product is formed;
b) heat-treating the formed product in a temperature range which is greater than or equal to about 300° C. to less than about 450° C. during a heat treatment time from 10 minutes to 168 hours.

It has been found that by heat-treating a product obtained after plastic deformation under cryogenic conditions, the combined mechanical properties, such as the ductility and tensile strength, will be greatly improved. The heat treatment temperatures range from about 300° C. to less than about 450° C.

Figure 1:
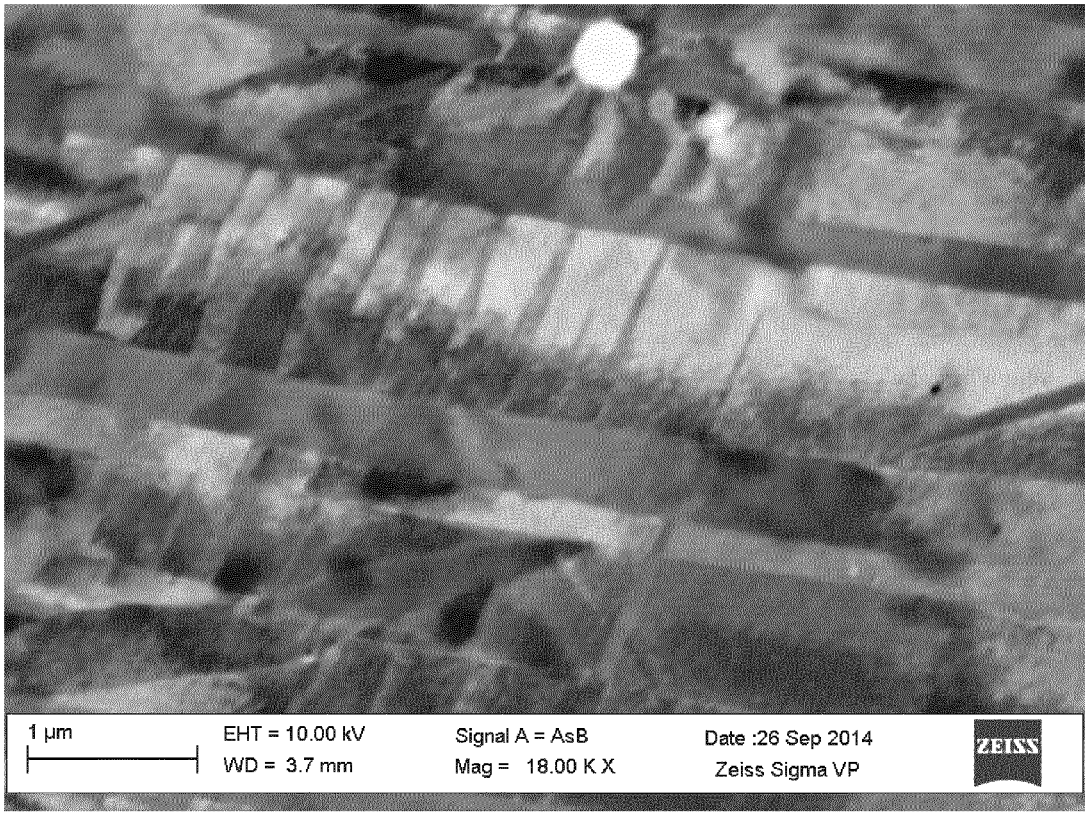
FIG. 1 shows a SEM image of nano-twins in an object of commercially pure titanium, which has been plastically deformed at cryogenic temperatures.

The plastic deformation is performed by tension, i.e. by drawing the object to form the product. The plastic deformation will introduce nano-twins in the product as shown is in FIG. 1. These twins are mechanically stable and will therefore contribute to the improvement of the mechanical strength of a product manufactured by the process as defined hereinabove or hereinafter.

Additionally, it has surprisingly been found that in the present process, the formed nano-twins are kept intact for heat treatment times up to about 168 hours, i.e. the nano-twins have been found to be thermally stable. The deformation process introduces a lot of residual stresses built up in the product. During the heat treatment it is assumed, without being bound to any theory, that a recovery process occurs. The recovered structure is characterized by a softening of the material and a lower level of residual stress. The applied temperature ranges i.e. 300-450° C. which is below the recommended temperatures used in conventional recovery annealing for stress relieving of CP Ti, found in the literature (M. J. Donachie, *Titanium: A Technical Guide, 2nd Edition*, Materials Parkl, Ohio, USA: ASM International, 2000). As can be seen in the tensile test curves (FIG. 2*a* and FIG. 2*b*), the samples heat treated at temperatures from 300° C. to below 450° C. withstand larger strains to failure, i.e. have significantly improved EL (elongation, i.e. strain value at failure (x-axis), thus meaning that the ductility is high). This is a characteristic feature for successful recovery process. The decrease in the stress (y-axis) and YS (yield strength, i.e. stress value where the material starts to plastically deformed) surprisingly small considering the significant improvement in the EL values (see also tables 2a and 2b).

The formed product may, according to the process as defined hereinabove or hereinafter be brought to room temperature before the heat treatment step. Additionally, the product may also be stored at room temperature during a suitable time.

According to the process as defined hereinabove or hereinafter, the object of CP Ti may be brought to a temperature below −100° C. before plastic deformation is imparted, such as to a temperature about −196° C., before mechanical deformation is imparted.

The plastic deformation may correspond to a deformation of at least 70% of the total fracture strain. This means that the CP Ti will enter the full plasticity region without having any effects from necking or fracture. The total fracture strain means how much strength the material can withstand before fracture.

The heat treatment step of the process as defined hereinabove or hereinafter may be performed at a temperature range of from about 350 to 440° C., such as a temperature range of from about 360 to about 430° C., such as at a temperature range of from about 380 to about 410° C., such as about 300 to about 400° C.

The process as defined hereinabove or hereinafter will provide a product with a microstructure comprising nano-twins with a higher twin density of compression twins than tensile twins.

Figure 3:
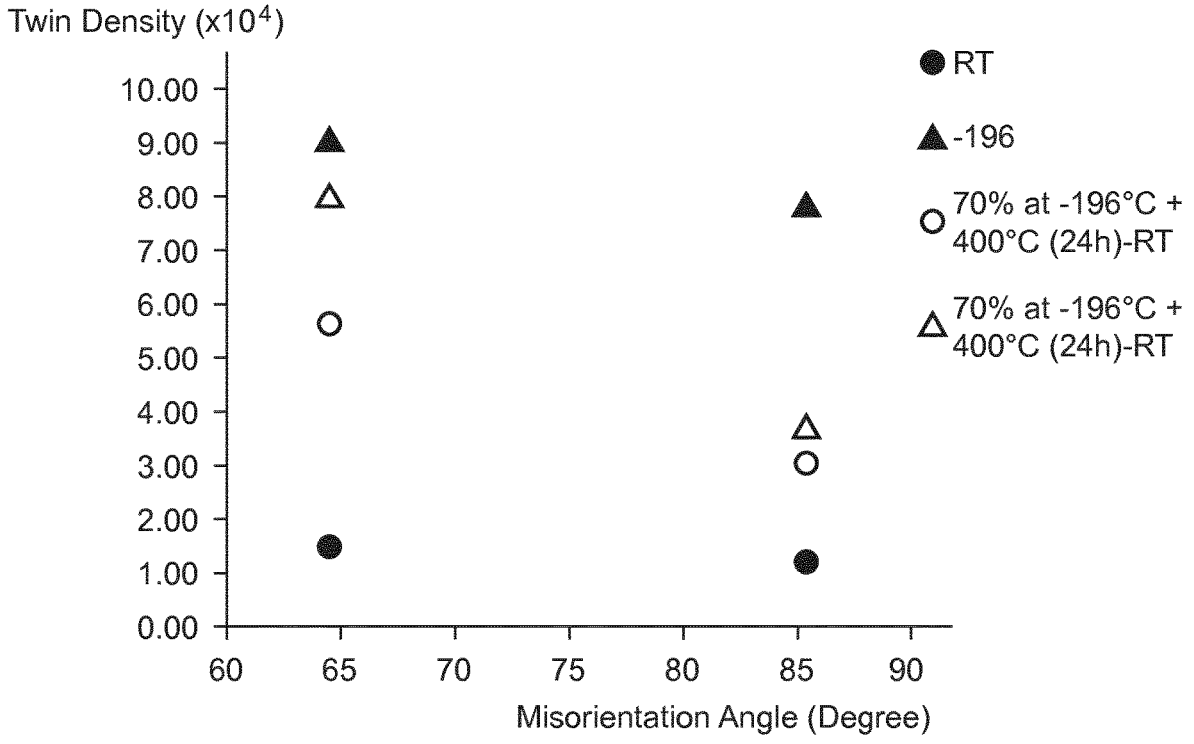
FIG. 3 shows the fraction of tensile twins at 85° misorientation angle versus compression twins at 64° misorientation angle.

FIG. 3 shows the fraction of twins expressed as twin density (i.e. the number of twins/surface area) for compressions twins and tensile twins in the CP Ti samples manufactured according to the process as defined hereinabove and hereinafter and comparative examples. It is also shown that the twin density (both compression and tensile twins) is lower in samples tested at room temperature (RT) compared to the samples that have been tested at −196° C., plastically deformed at −196° C. and subsequently heat treated. It should be noted that the density of tensile twins is always lower than the compression twins in all the samples that are cryogenically treated and heat treated. Furthermore, as can be seen from FIG. 3, there is a significant difference in the amount of compression twins and tensile twins, i.e. the amount of compression twins is much higher than the amount of tensile twins after heat treatment of the samples. In addition, at the temperature range according to the present disclosure, the material will undergo a recovery annealing thus increasing the EL values. FIG. 3 shows additionally that the tensile twin density is slightly lower after than before the heat treatment. FIG. 3 shows that present process as defined hereinabove and hereinafter will provide a CP Ti product having a microstructure with a substantial higher amount of compression and tensile twins compared to the Ti sample deformed at room temperature (RT in FIG. 3).

The process as defined hereinabove or hereinafter is further illustrated by the following non-limiting examples.

EXAMPLES

The commercially pure titanium used in the example was of grade 2 and had the following nominal composition in weight %:

nitrogen 0.02;
carbon 0.01;
hydrogen 0.001;
iron 0.09;
oxygen 0.15-0.16;
balance titanium.

The start material was a bar material, which was produced using conventional metallurgical processing including melting, casting, forging/hot rolling and extrusion. The obtained bar material was fully annealed prior to the mechanical deformation.

The bar material used was cooled to a temperature below −80° C. to −196° C. and was subsequently plastically deformed at these temperatures using liquid nitrogen ($N_2$ (1)) at −196° C. and $CO_2$ gas cooling system at −80° C. The bar material, which had an initial gauge length of 50 mm was plastically deformed by tension at a rate of 0.00025 mm/min until 70% of failure strain.

After imparting the plastic deformation, the obtained products were brought to room temperature and subjected to a heat treatment in the temperature range 100-400° C. for treatment times up to about 168 hours. After the heat treatment, the samples were quenched in water and then tensile tested at room temperature.

Tensile (5C50) test bars of 5 mm in diameter and a gauge length of 50 mm according to the standard SS 112113, which is in accordance with the ASTM F 67 specification, were prepared from the obtained product. Tensile tests were performed using an Instron 1342 universal testing machine.

The mechanical properties of the obtained objects were tested at room temperature.

Table 1 shows the values of the tensile strength obtained at the three investigated temperatures of the obtained objects without heat treatment. The samples have been prepared as described above.

TABLE 1

| T ° C. | $YS_{0.2}$ MPa | $YS_{1.0}$ MPa | UTS MPa | RA % | EL % |
|---|---|---|---|---|---|
| RT | 282 | 388 | 478 | 29 | 20 |
| −80 | 498 | 534 | 582 | 38 | 24 |
| −196 | 550 | 676 | 953 | 50 | 42 |

Table 2a and Table 2b show the mechanical data of the obtained samples that were heat treated for 24 or 168 hours.

TABLE 2a

| Mechanical data of the obtained samples that were heat treated for 24 hours Heat treated for 24 hours | | | | | |
|---|---|---|---|---|---|
| T ° C. | $YS_{0.2}$ MPa | $YS_{1.0}$ MPa | UTS MPa | RA % | EL % |
| 100 | 1008 | 1090 | 1124 | 28 | 21 |
| 200 | 956 | 1064 | 1092 | 28 | 20 |
| 300 | 911 | 978 | 1045 | 34 | 26 |
| 400 | 883 | 950 | 1034 | 74 | 30 |

TABLE 2b

| Mechanical data of the obtained samples that were heat treated for 168 hours Heat treated for 168 hours | | | | | |
|---|---|---|---|---|---|
| T ° C. | $YS_{0.2}$ MPa | $YS_{1.0}$ MPa | UTS MPa | RA % | EL % |
| 100 | 978 | 1113 | 1139 | 41 | 18 |
| 200 | 967 | 1060 | 1090 | 45 | 22 |
| 300 | 692 | 952 | 1045 | 53 | 28 |
| 400 | 788 | 924 | 1028 | 76 | 32 |

Figure 2A:
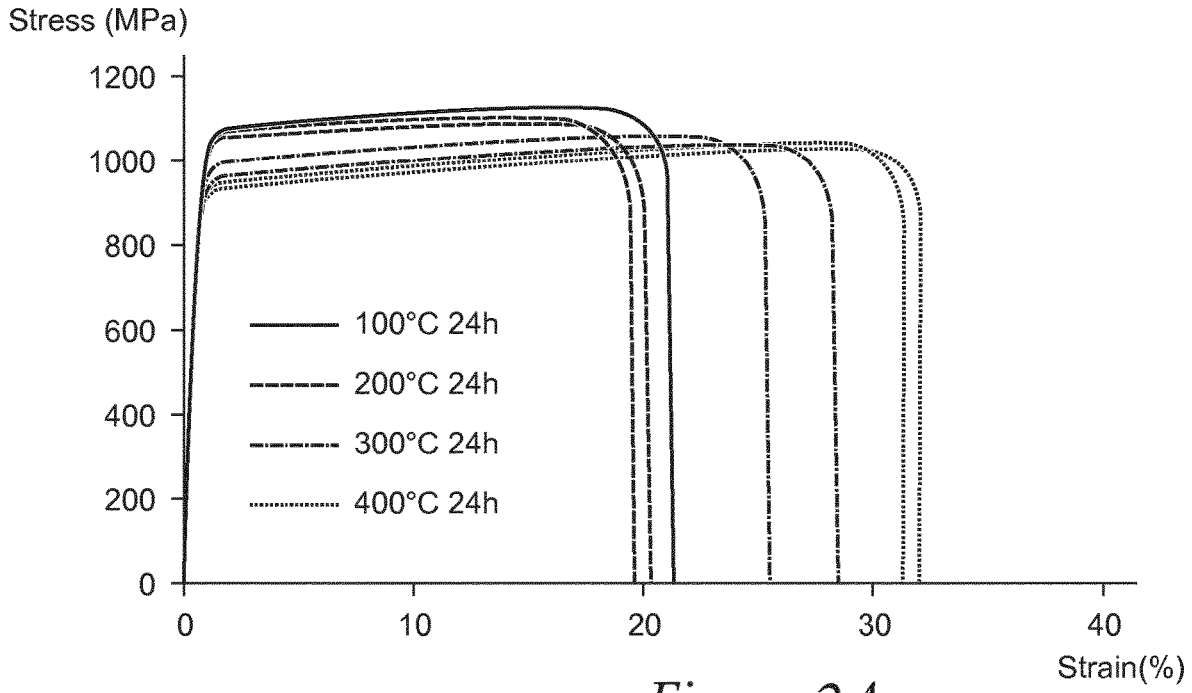
FIGS. 2*a* and 2*b* show tensile test curves from samples which have been plastically deformed in cryogenic temperatures and then heat treated at different temperatures.
Figure 2B:
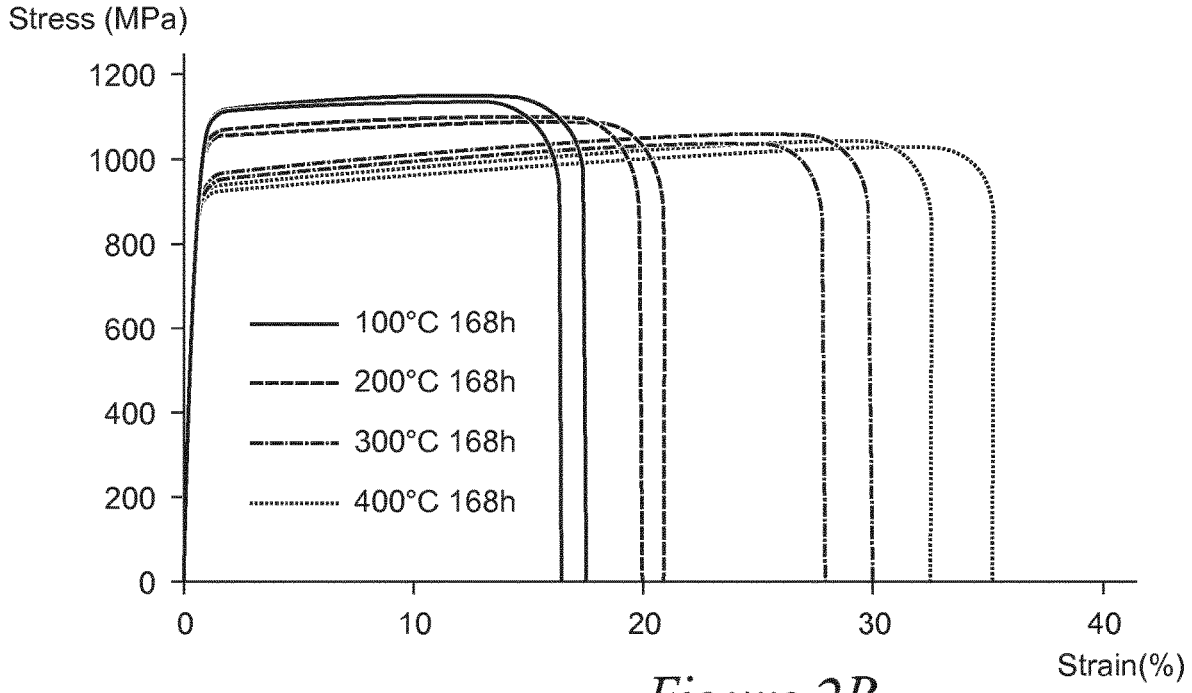

As can be seen from Table 2a and Table 2b, the mechanical properties are affected by the heat treatment (see also FIG. 2*a* and FIG. 2*b*). It is shown that the YS (yield strength) and UTS (ultimate tensile strength) values decreases with increasing heat treatment temperature and that there is an increase in EL (elongation). Beside this, it can be noted in Table 2a, Table 2b, FIG. 2*a* and FIG. 2*b* that there is effect of holding time (24 and 168 hours) on the tensile properties. At the longer holding times (i.e. 168 hours) the YS value is decreased, while the UTS and EL values remain unaffected.

As can be seen from Table 2a and Table 2b, the best combined mechanical properties (i.e. YS, UTS and EL) of a product is obtained at temperatures above 300° C. and below 450° C.

FIG. 3 shows the Vickers hardness values of the product produced by the processes as mentioned above at different temperature. It can be seen from FIG. 3, that the influence of deformation at cryogenic temperature (−196° C.) hardly affects the hardness until about 400° C. Beyond this, the hardness tend to lower and drop drastically as noted below 450° C. Therefore, the best combination of YS, UTS and EL is obtained when the product is heat treated above 300° C. and below 450° C.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

The invention claimed is:

1. A process for manufacturing a product of commercially pure titanium, wherein said process comprises the steps of:

a) plastically deforming by tension an object of commercially pure titanium in a temperature below −80° C. until the product is formed, wherein a microstructure of the product includes a plurality of tensile twins having a misorientation angle of 85°±5° and a plurality of compression twins having a misorientation angle of 64°±5°; and b) heat-treating the formed product in a temperature range of from 300 to below 450° C. during a treatment time from 10 minutes to 168 hours, wherein the heat-treating reduces a level of residual stress in the product while the plurality of tensile twins and the plurality of compression twins remain intact.

2. The process according to claim 1, wherein the formed product is brought to room temperature before the heat treatment.

3. The process according to claim 1, wherein the object is brought to a temperature below −100° C. before the plastic deformation is imparted.

4. The process according to claim 1, wherein the object is brought to a temperature about −196° C. before the plastic deformation is imparted.

5. The process according to claim 1, wherein plastically deforming by tension produces a plastic deformation that corresponds to deformation of at least 70% of a total fracture strain.

6. The process according to claim 1, wherein the heat treatment is performed at a temperature range of from 350 to 440° C.

7. The process according to claim 1, wherein the heat treatment is performed at a temperature range of from 360 to 430° C.

8. The process according to claim 1, wherein the heat treatment is performed at a temperature range of from 380 to 410° C.

9. The process according to claim 1, wherein the heat treatment is performed at a temperature range of from 300 to 400° C.

10. The process according to claim 1, wherein, after heating-treating, the microstructure has a higher twin density of compression twins than tensile twins.

11. The process according to claim 1, wherein plastically deforming by tension includes a drawing process.

12. The process according to claim 1, wherein the object of commercially pure titanium has a composition consisting of (in weight %):

nitrogen max 0.05,
carbon max 0.08,
hydrogen max 0.015,
iron max 0.5,
oxygen max 0.4, and
titanium balance.

13. A process for manufacturing a product of commercially pure titanium, wherein said process comprises the steps of:

a) plastically deforming by tension an object of commercially pure titanium in a temperature below −80° C. until the product is formed, wherein a microstructure of the product includes a plurality of tensile twins having a misorientation angle of 85°±5° and a plurality of compression twins having a misorientation angle of 64°±5°; and b) heat-treating the formed product in a temperature range of from 300 to below 450° C. during a treatment time from 10 minutes to 168 hours, wherein plastically deforming by tension produces a plastic deformation that corresponds to deformation of at least 70% of a total fracture strain, and wherein, after heat-treating, the plurality of tensile twins and the plurality of compression twins are mechanically stable.

14. The process according to claim 13, wherein the object of commercially pure titanium has a composition consisting of (in weight %):

nitrogen max 0.05,
carbon max 0.08,
hydrogen max 0.015,
iron max 0.5,
oxygen max 0.4, and
titanium balance.

15. The process according to claim 14, wherein the formed product is brought to room temperature before the heat treatment.

16. The process according to claim 14, wherein the object is brought to a temperature about −196° C. before the plastic deformation is imparted, and wherein the heat treatment is performed at a temperature range of from 380 to 410° C.

17. The process according to claim 14, wherein the object is brought to a temperature below −100° C. before the plastic deformation is imparted, and wherein the heat treatment is performed at a temperature range of from 300 to 400° C.

* * * * *